US006129545A

United States Patent [19]

Kahlke et al.

[11] Patent Number: 6,129,545

[45] Date of Patent: Oct. 10, 2000

[54] GAS BURNER WITH POLLUTION-REDUCING FEATURES

[75] Inventors: Michael Kahlke, Bingen, Germany; Klaas W. Roelfsema, Gasselternijveenschemond, Netherlands; Herwig Scheidler, Mainz, Germany

[73] Assignee: Schott Glaswerke, Mainz, Germany

[21] Appl. No.: 08/979,532

[22] Filed: Nov. 26, 1997

[30] Foreign Application Priority Data

Nov. 26, 1996 [DE] Germany ..... 196 48 808

[51] Int. Cl.[7] ..... F23D 14/12

[52] U.S. Cl. ..... 431/328; 431/326; 126/39 J

[58] Field of Search ..... 431/326, 328, 431/329; 126/39 J

[56] References Cited

U.S. PATENT DOCUMENTS

| | | | |
|---|---|---|---|
| 3,527,199 | 9/1970 | Perry | 431/328 |
| 3,857,670 | 12/1974 | Karlovetz et al. | 431/329 |
| 3,922,136 | 11/1975 | Koch | 431/328 |
| 4,039,275 | 8/1977 | McGettrick | 431/329 |
| 4,157,155 | 6/1979 | Smith | 431/328 |
| 4,657,506 | 4/1987 | Ihlenfield et al. | 431/329 |
| 5,165,887 | 11/1992 | Ahmady | 431/329 |
| 5,356,487 | 10/1994 | Goldstein et al. | 431/328 |
| 5,406,703 | 4/1995 | Haen et al. | 29/890.02 |
| 5,458,484 | 10/1995 | Ripka | 431/328 |

*Primary Examiner*—Carroll Dority
*Attorney, Agent, or Firm*—Jansson, Shupe, Bridge & Munger, Ltd.

[57] ABSTRACT

A gas burner has a perforated, hollow body around and defining a combustion chamber. Gaseous fuel is fed to one side of the body, combustion occurs on the other side and the perforations provide a spatial connection between the fuel feed side and the combustion side. The new burner reduces exhaust gas emissions and offers a wide range of performance in the amount of heat energy provided, in the permissible range of gas pressure and in the range of fuels and fuel/air mixtures that can be used with it.

3 Claims, 5 Drawing Sheets

GAS BURNER WITH POLLUTION-REDUCING FEATURES

CLAIM OF PRIORITY

This application claims priority from German application DE 196 48 808.7-13 filed in Germany on Nov. 26, 1996.

FIELD OF THE INVENTION

This invention relates generally to combustion and, more particularly, to gaseous fuel combustion using a porous flamehandler.

BACKGROUND OF THE INVENTION

Gas burners, in wide use for decades, are fueled by combustible gases with or without being mixed with air. Very commonly used combustible gases includes natural gas and liquefied propane (LP) gas. (Liquefied propane is stored under pressure in liquid form and becomes gaseous when fed to a gas burner at lower pressure.) Gas burners are useful to heat water, heat a room or a building, carry out industrial processes and for many other purposes.

Known gas burners include at least two broad configurations. In one, holes are formed in a sheet metal or cast body and define a straight line, a circle or some other shape. U.S. Pat. No. 5,406,703 (Haen et al.) discloses a burner of this type. In such configuration, holes constitute a relatively small percentage of the overall body area.

Another known configuration uses a porous flame handler. Burners of this type are disclosed in U.S. Pat. No. 4,657,506 (Ihlenfield et al.) and U.S. Pat. No. 5,165,887 (Ahmady). The burner disclosed in the Ihlenfield et al. patent has a rigid inner support member through which gas is fed. Such member has a multiplicity of small openings which cover the entire axial and circumferential extent of that portion of the member which forms the burner.

The rigid support member is surrounded by a cylinder-shaped woven metal fabric tube spaced radially outwardly from the support member. Gas fed into the support member exits the member openings and the openings in the metal fabric tube and combustion is supported on the exterior of such tube.

The burner disclosed in the Ahmady patent has an inner element comprised of woven ceramic cloth wrapped around a supporting wire mesh cylinder. Gaseous fuel having no air mixed with it is fed into such cylinder. (The patent describes that if the ceramic cloth is wrapped in several layers, no support is needed.)

This inner element is received in and surrounded by a metal tube spaced from the element to define a plenum between them. There are separate feed ports for gas and air. In one configuration, gas is fed into the inner element, air to the plenum and combustion occurs in the plenum, i.e., on the outer surface of the inner element and between such element and the surrounding metal tube. In another configuration, gas is fed to the plenum, air is fed into the inner element and combustion occurs on the inner surface of the inner element.

While the burners disclosed in the Ihlenfield et al. and Ahmady patents are presumed to be suitable for their intended purposes, they are not without disadvantages. A seeming disadvantage of the Ihlenfield et al. burner involves the fuel feed rate and the burnoff rate. If more gas is supplied in a effort to increase heat output, it would appear that at some gas feed rate, the flame "lifts away" from the mesh. It is understood that this may actually diminish heat output. And at some even-higher gas feed rate, the burner is likely to extinguish completely.

Another disadvantage of the Ihlenfield et al. burner and, apparently, of that version of the Ahmady burner in which combustion occurs in the plenum is that there is no provision for "afterburning" the products of combustion.

Still another disadvantage of the Ihlenfield et al. and Ahmady burners is that neither is well suited for use with a conventional cooking devices such as a stove top. This is not surprising in view of the fact that they are configured for specific applications.

A seeming disadvantage of the burner disclosed in the Ahmady patent is its nominal specified gas/air feed rate cannot be exceeded. Since combustion occurs within the surrounding closed metal tube, i.e., in an unvented space, gas and air should not be fed in at a rate which unduly pressurizes the tube. There is apparent risk of tube rupture. Exhaust gas emission may be unduly elevated, particularly with regard to the proportion of carbon monoxide contained in such emission.

An improved gas burner which addresses disadvantages of known porous burners would be an important advance in this field of technology.

OBJECTS OF THE INVENTION

An object of the invention is to provide an improved gas burner addressing some of the problems and shortcomings of the prior art.

Another object of the invention is to provide an improved gas burner which "afterburns" byproducts of combustion.

Another object of the invention is to provide an improved gas burner which reduces air pollution.

Still another object of the invention is to provide an improved gas burner of the porous type which is suitable for use with conventional cooking devices such as stove tops.

Another object of the invention is to provide an improved gas burner readily adapted to a wide range of gas pressures.

Still another object of the invention is to provide an improved gas burner readily adapted to a wide range of fuels and fuel/air mixtures. How these and other objects are accomplished will become apparent from the following descriptions and from the drawings.

SUMMARY OF THE INVENTION

The new gas burner comprises a housing-like imperforate prechamber having a top exhaust opening. A burn-off device formed as a bulbous body is supported by and extends downwardly into the prechamber. The body and the prechamber are spaced from one another and define a gas feed region between them. Such feed region is around the combustion side of the body and is so named because it receives a pressurized gaseous fuel/air mixture from a gas supply line and permits such mixture to flow entirely around the body.

The body is hollow, has an outer combustion gas side and an interior burner side. The burner side defines a burner region or combustion chamber within the body. The body has perforations connecting the gas feed region and the burner region.

In more specific aspects of the invention, the body extends around an axis through the gas feed region and gas flows from the gas feed region inwardly through the perforations toward the axis. The body has an upper perimeter portion and when the burner is ignited, flames extend from such portion toward the axis. The body also has a lower portion and when the burner is ignited, flames extend from such lower portion, as well. The flames extending from the lower portion produce a gaseous byproduct of combustion, e.g., carbon monoxide. That byproduct of combustion passes through the flames extending from the upper perimeter, thereby reducing such byproduct by burning it. One might term this "afterburning" of the pollutant carbon monoxide.

In other aspects of the invention, the body includes a top vent opening having a vent flange around it. The prechamber exhaust opening has a fastening flange and the flanges are coupled to one another for supporting the body suspended in the prechamber. The lower terminus of the body is spaced above the gas supply line. And when the burner is equipped with an apertured distribution plate between the prechamber and the gas supply line (as the preferred burner is), the lower terminus of the body is also spaced above the distribution plate.

The body includes a top vent opening proximate the upper perimeter portion and having a maximum dimension across it. When the burner is ignited, the flames extend from the upper perimeter portion toward the axis and one of the flames has a maximum length. In a highly preferred embodiment, the maximum dimension across the upper perimeter portion is not more than twice the maximum length. In that way, it is substantially assured that byproducts of combustion produced by flames extending from the body lower portion will be subjected to reduction by exposure to very high temperature.

In yet other aspects of the invention, the body is hollow and extends around the combustion chamber. In one preferred embodiment, such chamber is shaped as a partial ellipsoid and has an opening for exhausting gas therethrough. In another preferred embodiment, the chamber is shaped as a partial sphere with an exhaust opening.

Each perforation has an area and the average area of the perforations is in the range of 0.25 $mm^2$ to 4 $mm^2$. In more specific embodiments having perforations of particular shapes, the average area of the perforations is in the narrower range of 0.6 $mm^2$ to 2.6 $mm^2$.

In a highly preferred embodiment, the body is formed using reticulated, high temperature resistant fibers which are sufficiently far apart to define perforations between the fibers. In the detailed description, it is explained how such body can be made without using any additional structural support for the fibers. And in another embodiment, the fibers are supported by a shaped steel plate and the plate also includes perforations so that gaseous fuel can propagate from the gas feed region through the body into the combustion region.

Further aspects of the invention are set forth in the following detailed description and the drawings. In this specification, the term "perforation" is used to mean an opening, however formed, i.e., whether by punching, piercing or by employing a fabric having openings therethrough which result from the fabric weaving process.

BRIEF DESCRIPTIONS OF THE DRAWINGS

FIG. 1 is a cross-sectional elevation view of the new burner. Surfaces of parts are shown in dashed line and other parts are broken away.

FIG. 2*a* is a perspective view showing one preferred shape embodiment, a partial ellipsoid, of the body used in the burner of FIG. 1.

FIG. 2*b* is a perspective view showing another preferred shape embodiment, a partial sphere, of the body used in the burner of FIG. 1.

FIGS. 3*a*, 3*b* and 3*c* are perspective views showing three ways to form the body to have perforations therethrough.

FIGS. 4*a* through 4*e* show openings of various configurations which may be formed in sheet metal used to make the burner body. Parts are broken away.

DETAILED DESCRIPTIONS OF PREFERRED EMBODIMENTS

Figure 1:
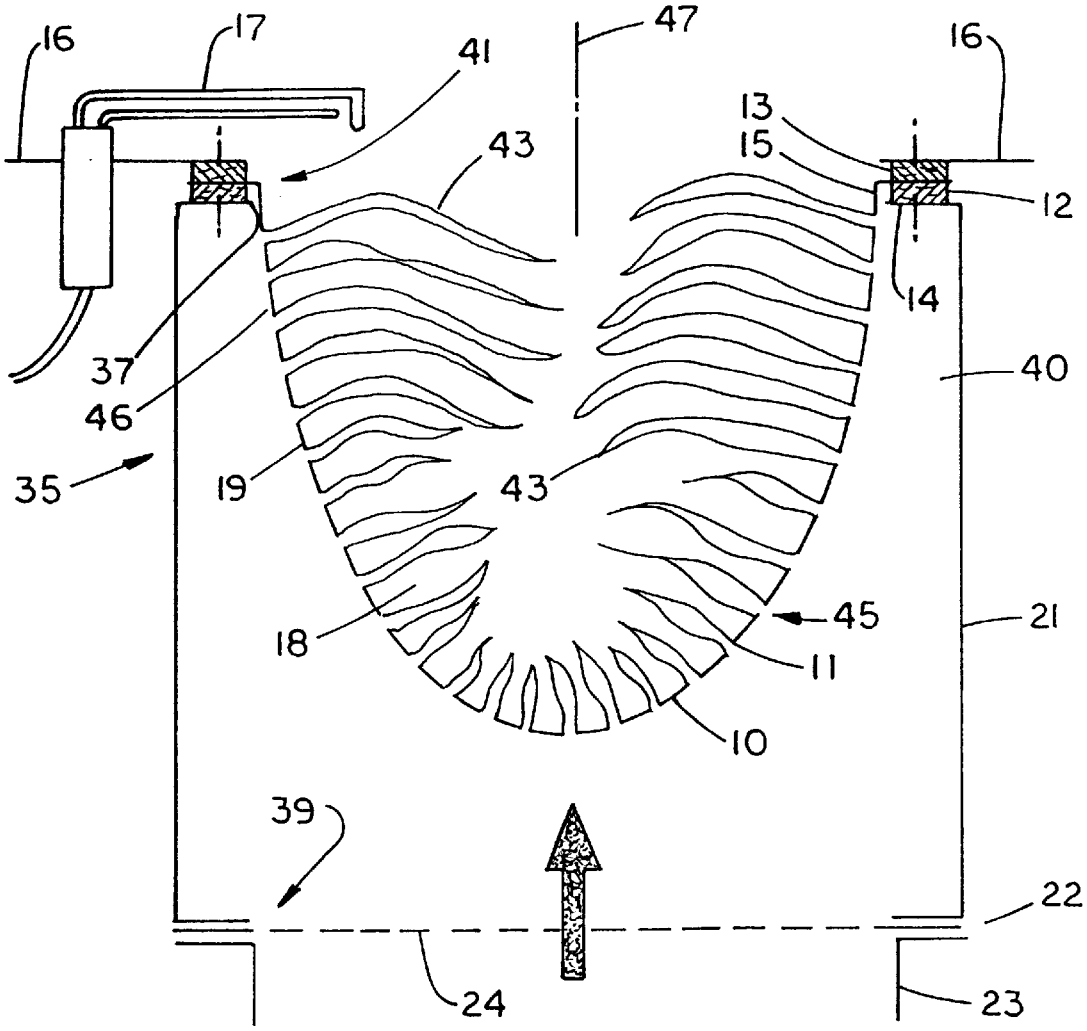

Referring to FIG. 1, the gas burner 35 has a prechamber 21 that forms a housing. The cross sectional shape of the prechamber 21 is not critical and prechambers having at least round or square cross sections are operable. The prechamber 21 has an upper opening 37 and a lower opening 39, the latter surrounded by a flange connection 22, onto which a combustion gas supply line 23 can be attached. An apertured distribution plate 24 is held in a clamped manner between the combustion gas supply line 23 and the prechamber 21. The distribution plate 24 ensures that the combustion gas is uniformly distributed in the prechamber 21 around the gas feed region 40.

A flange 14 from the prechamber 21 is curved inwardly at a right angle in the area of the upper opening 37 and a gasket 12 is set on the flange 14. The gasket 12 bears the fastening flange 15 of the body 10. Another gasket 13 is set onto the fastening flange 15 and is covered by a fastening plate 16. The fastening plate 16 is screwed to the flange 14, so that the fastening flange 15 is held between both gaskets 12, 13 in a clamped manner. An ignition system 17 can also be attached to the fastening plate 16.

Figure 2A:
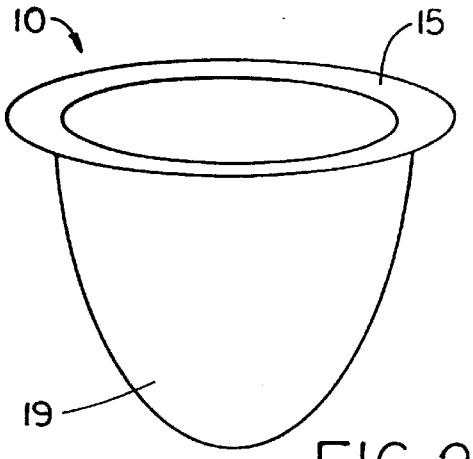
Figure 2B:
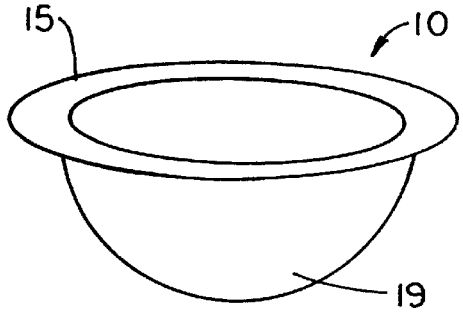

The body 10 is designed as a bulbous, hollow body 10 which projects into the prechamber 21 and, with the prechamber 21, defines the gas feed region 40 therebetween. In one preferred embodiment shown in FIGS. 1, 2*a* and 6, the geometry of the body cross section is that of a partial ellipsoid. In another embodiment shown in FIG. 2*b*, the geometry of the body cross section is that of a partial sphere.

Whatever the specific cross section of the body 10, such body is formed as a shell 19 having a top vent opening 41 and a vent or fastening flange 15 around the opening. The body 10 is provided with perforations 11.

Figure 3A:
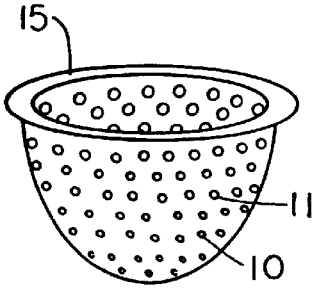

There are a variety of possibilities for making the body 10. One way is to use perforated steel plate as shown in FIG. 3*a*. However, it is preferred to keep the temperature of the outward surface of the body 10 at the gas feed region 41 as low as possible.

Figure 3B:
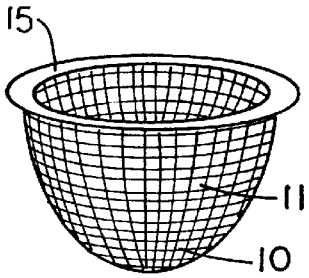
Figure 3C:
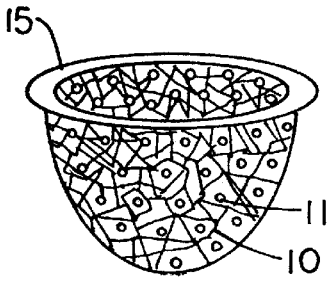

Therefore, another arrangement is shown in FIG. 3*b* in which the body 10 is made of interwoven high temperature resistant fibers. Fiber interweaving is in a manner that perforations 11 are formed between the individual fibers. FIG. 3*c* shows a fibrous-like perforated web comprising high temperature resistant fibers. For the embodiments according to FIGS. 3*b* and 3*c*, metallic or ceramic fibers can be used. However, ceramic fibers that can subsequently be covered with silicone carbide are preferable. The interweaving or fibrous web is hardened by the coating of silicone carbide. The body 10 is thereby constructed in a molded form-stable manner, so that no further structural support is required. Furthermore, it ensures that, when the molded body 10 is being handled, no tears can occur that could affect the geometry of the perforations 11. In still another arrangement, a perforated steel plate is interior of a fibrous overlay or is between a pair of such overlays.

When the gas burner 35 is operating, combustion gas is supplied by the combustion gas supply line 23 by means of a blower of a gas/air mixture device which is not illustrated in the drawing. The combustion gas flows from the pre-chamber 21 and, more specifically, from the feed region 40, through the perforations 11 in the body 10 into the combustion chamber 18 where the gas ignites and burns.

A number of flames 43 are illustrated in FIG. 1 and it is clear from this drawing that the entire combustion chamber 18 is filled with flames 43. A swirling and recirculation of the flames 43 and of any gaseous or particulate residue product in the flames 43 thereby results. This ensures that the exhaust gas that arises from the flames 43 at the lower portion 45 of the body 10 undergoes afterburning by those flames 43 extending from the upper perimeter portion in a multistage process. Unburned carbon monoxide is considerably reduced. It is also possible to lower the nitrous oxide emissions in this manner.

Figure 7:
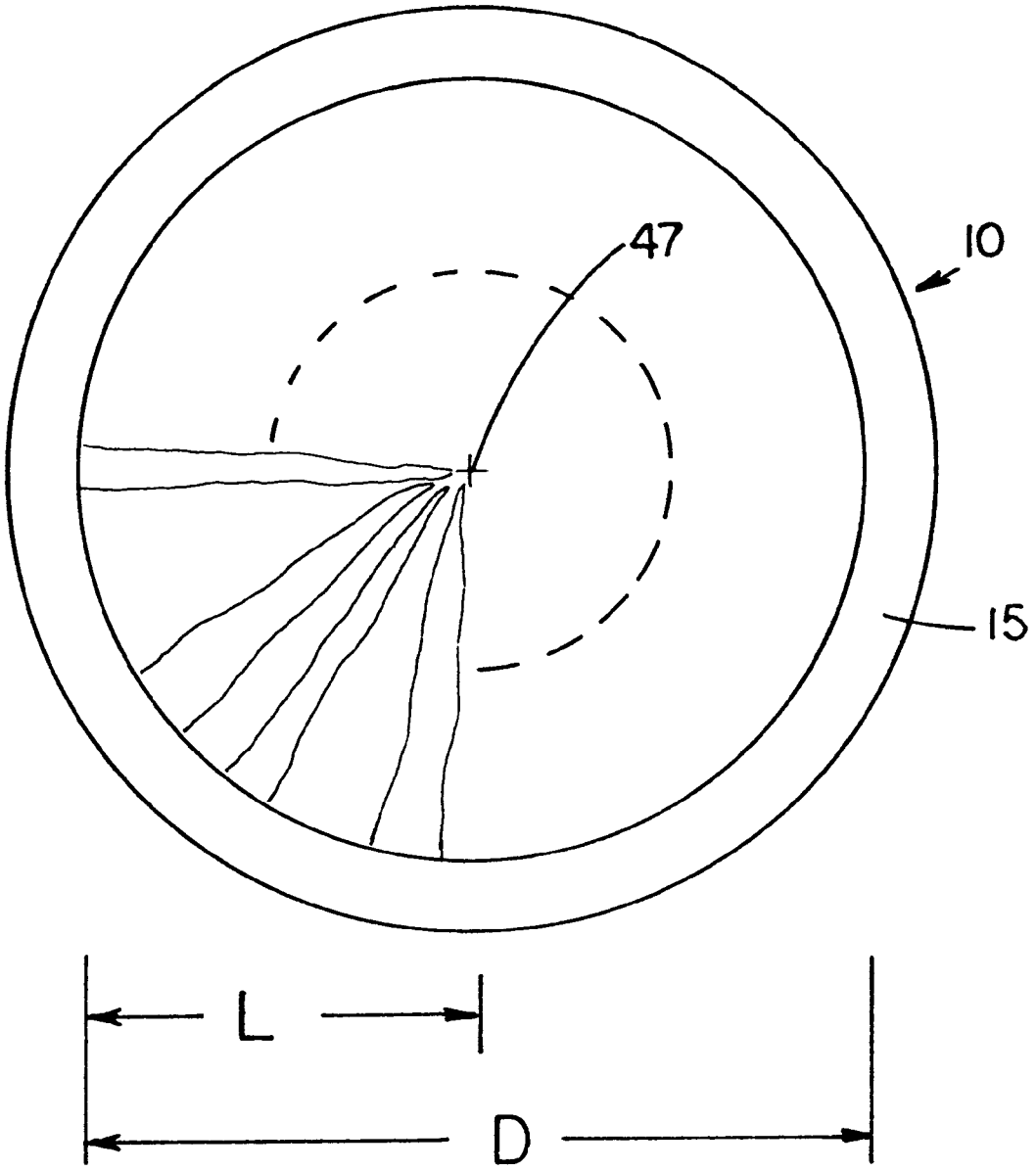
FIG. 7 is top plan view of the body of the gas burner.

Referring next to FIG. 7, when making a body 10, it should be noted that the maximum dimension D across the body 10 should not be greater than twice the maximum flame length L. This ensures that the flames 43, which extend toward the central axis 47, always make contact with each other. The entire combustion chamber 18 is hereby filled with flames 43, so that optimal recirculation and byproducts burning occurs. As an example, a maximum dimension D of 110 mm. and a flame length L of 55 mm. would work well together.

Figure 4A:
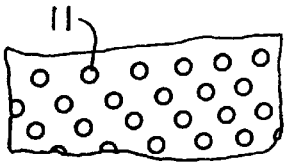
Figure 4B:
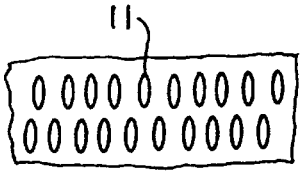
Figure 4C:
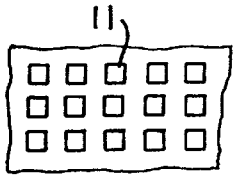
Figure 4D:
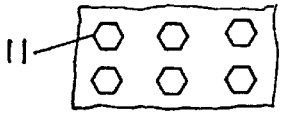
Figure 4E:
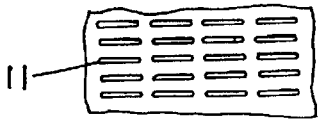

FIGS. 4*a* through 4*e* show various configurations of the perforations 11. Such configurations include round (FIG. 4*a*), ovoid (FIG. 4*b*), square (FIG. 4*c*), polygonal (FIG. 4*d*) and elongate rectangular (FIG. 4*e*). In general, the average area of the perforations 11 should be in the range of 0.25 $mm^2$ to 4 $mm^2$ and, more narrowly, in the range of 0.6 $mm^2$ to 2.6 $mm^2$. Guidelines for selecting the spacing between perforations 11 and for selecting perforation area are set out below.

Figure 5:
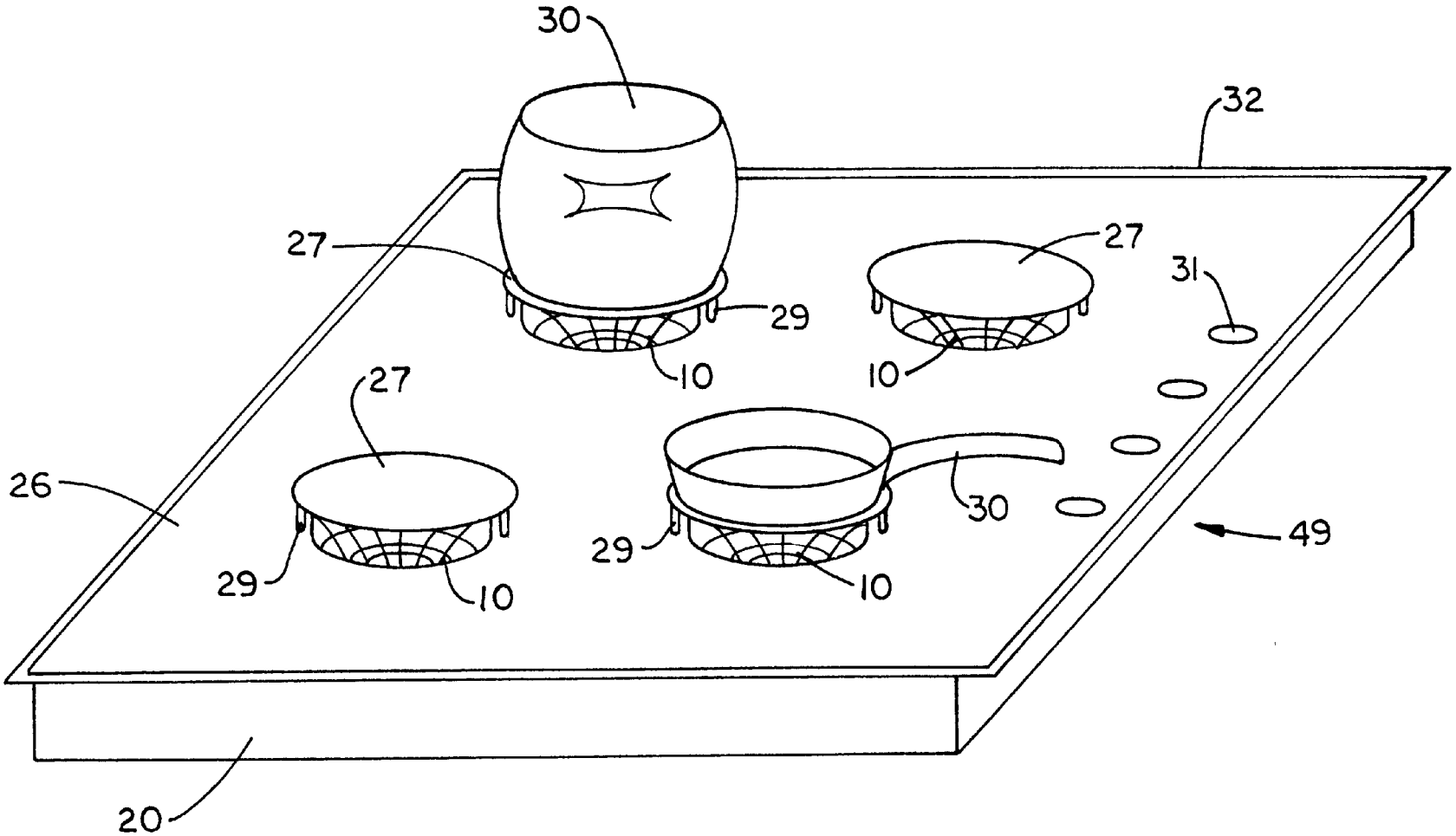
FIG. 5 is a perspective view of a stovetop cooking unit having mounted therein four gas burners according to the invention.
Figure 6:
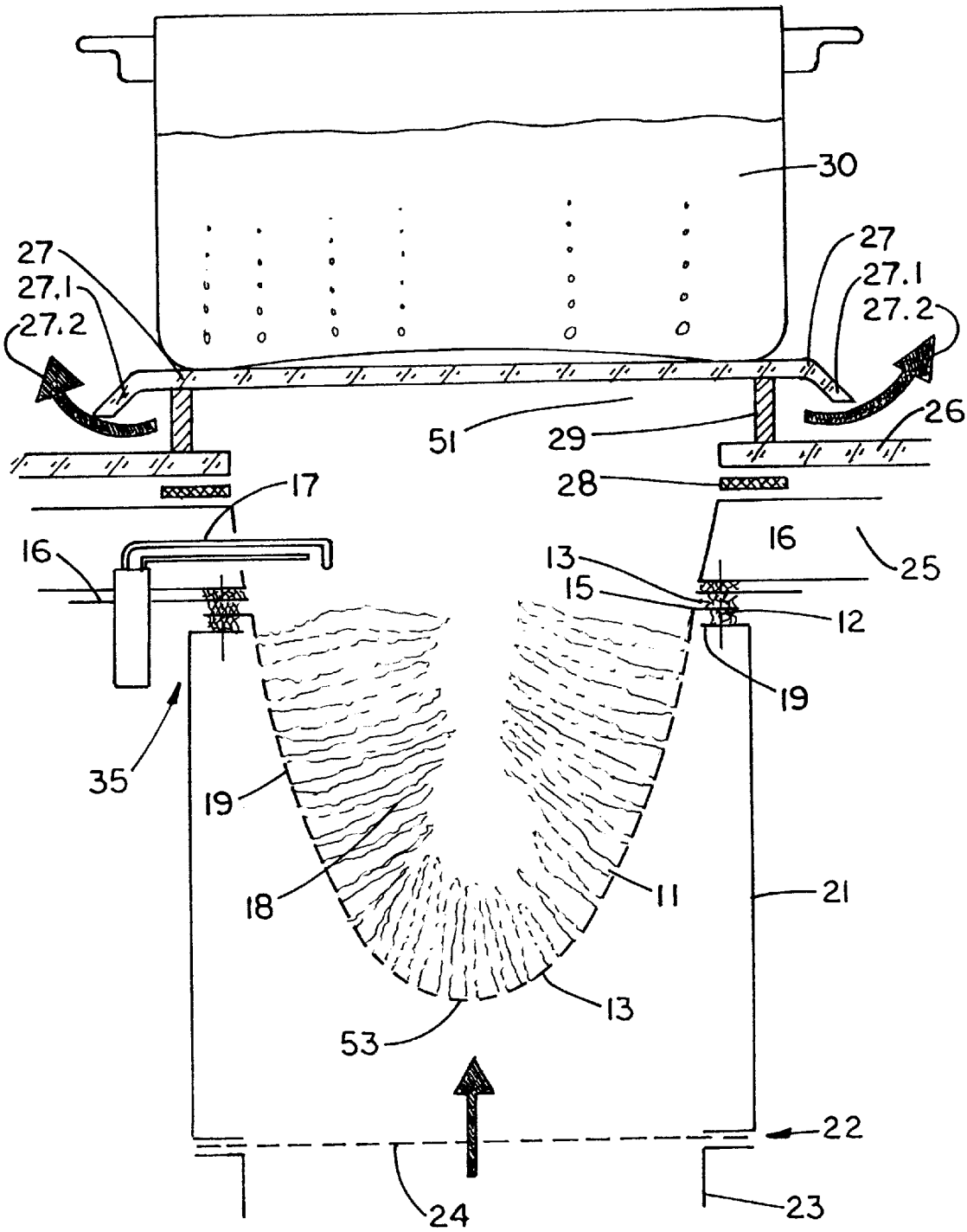
FIG. 6 is a cross-sectional elevation view of one of the burners of FIG. 5 having a cooking pot atop it. Surfaces of parts are shown in dashed line and other parts are broken away.

FIGS. 5 and 6 show an application of the inventive gas burner 35 in a cooking device 49. In this case a built-in cooking device is involved, having a housing 20 that forms the outer dimension. The housing 20 is connected to an outwardly projecting frame 32 around the housing perimeter. The housing 20 can be suspended in a recess of a working plate by the use of this frame 32.

Four gas burners 35, of which the bodies 10 can be seen, are lodged in the housing 20. Above or at the level of the burners 35 a cooking surface 26 is mounted over the frame 32. As far as the cooking surface 26 is concerned, it may comprise a glass ceramic cooking surface. To one side there are four apertures, each to receive a separate operating element 31 such as a burner control knob.

A cooking pot 30 rests upon a cover 27 and there is a spacer element 29 interposed between the cooking surface 26 and the cover 27. A spacer element 29 may be embodied as an annular ring having exhaust gas channels 27.2 therethrough which, in number and size, provide a low-pressure-drop exit path for exhaust gas. Or a spacer element 29 may be embodied as several individual standoff posts having such exhaust gas channels 27.2 therebetween. However the spacer element 29 is configured, it will have a top mouth 51 closed by the cover 27 when such cover 27 is in place.

In a highly preferred embodiment, the cover 27 is configured to prevent food or liquid boiled out of a pot 30 from getting into the burner 35. A preferred cover 27 has an outwardly extending lip or obliquity 27.1 around the cover perimeter and angled toward and overhanging the cooking surface 26. The cover 27 itself is advantageously connected to spacer element 29. And if it is desired to further prevent spilled food from getting into the burner 10, the cooking surface 26 can be configured with a short, upstanding wall around the element 29.

Flange body 25 is arranged under the cooking surface 26, with a gasket 28 in between. The gasket 28 is formed from an elastic material and contacts the underside of the cooking surface 26 directly under the spacer element 29. The actual gas burner is built onto the flange body 25 by means of fastening plate 16. It can be seen that the flange body 25 incorporates the ignition system 17 in its inside. The design of the gas burner of FIG. 6 corresponds to the gas burner illustrated in FIG. 1.

The exhaust gases that arise from combustion are guided out of the body 10 in the direction to the cover 27. Here they escape through the exhaust channels 27.2. The obliquities 27.1 thereby also act as an exhaust gas flow guide for gas redirection, so that a swirling of the exhaust gases results. The hot exhaust gases thereby flow uniformly upwardly around the cooking pot 30 and enhance the rate at which the contents of the pot 30 are heated.

Regarding selection of the configuration, area and spacing of the perforations 11, for a given gas fuel and burner inlet pressure, the perforations should be sufficiently close together that "cross ignition" between perforations occurs. In that way, an igniting spark applied near the top of the body 10 will result in gas ignition over the entire inward surface of the body 10.

Perforation sizing and spacing should also be selected so that the "outflow rate" of gas through the perforations 11 at least slightly exceeds the "burnoff rate." In that way, "backflashing," i.e., propagation of flame 43 into the gas feed region 40, is prevented. After appreciating the specification, persons of ordinary skill in the art will understand how to select, perhaps with limited experimentation, perforation area and spacing.

Aspects of the new burner 35 can be described in other ways. Referring again to FIGS. 1 and 7, the body 10 extends around a vertical axis 47 through the combustion chamber 18. Gas flows from the gas feed region 40 inwardly through the perforations 11 toward the axis 47. When the burner 35 is ignited, flames 43 extend from the upper perimeter portion 46 toward the axis 47. The lower terminus 53 of the body 10 is spaced above the gas supply line 23. And when the burner 35 is equipped with an apertured distribution plate 24 between the gas feed region 40 and the gas supply line 23 (and the preferred burner 35 is so equipped), the lower terminus 53 of the body 10 is also spaced above the distribution plate 24.

The new burner 35 evidences very desirable performance characteristics. For example, if the supply of combustion gas is greatly increased over some norm, the flames 43 do not "stand away" from the perforations 11 in the body 10. Seemingly, they are prevented from doing so as a consequence of the recirculation or swirling which occurs in the body 10. A relatively small burner 35 can be made to have a wide performance range. This leads to compact gas burners 35 that provide the design engineer the greatest degree of flexibility in structural and design implementation.

While the principles of the invention have been shown and described in conjunction with a few preferred embodiments, it is to be understood clearly that such embodiments are by way of example and are not limiting.

What is claimed:

1. A gas burner comprising:

an imperforate prechamber having a top exhaust opening;

a gas supply line coupled to the prechamber;

a separate body inserted into and supported by the prechamber in such a manner so as to allow the body to be removed and replaced from the prechamber, the body and the prechamber defining a gas feed region therebetween;

and wherein:

the body is hollow with a burner region therewithin and includes a top portion that is substantially completely open and a top vent opening with a vent flange therearound;

the prechamber exhaust opening has a fastening flange coupled to the vent flange for supporting the body in the prechamber; and the body includes perforations connecting the gas feed region and the burner region, thereby allowing combustion to take place within the burner region.

2. The burner of claim 1 including a distribution plate interposed between the prechamber and the gas supply line.

3. A gas flame burner including a burn-off device to which gas is supplied, the burn-off device including a shaped body formed using reticulated, high temperature resistant fibers and having a combustion gas side and a burner side, substantially the entirety of the body having perforations between the fibers providing a spatial connection between the combustion gas side and the burner side, and wherein the body is hollow and extends around the combustion chamber.

* * * * *